US005647386A

United States Patent [19]

Kaiser

[11] Patent Number: 5,647,386

[45] Date of Patent: Jul. 15, 1997

[54] AUTOMATIC PRECISION CLEANING APPARATUS WITH CONTINUOUS ON-LINE MONITORING AND FEEDBACK

[75] Inventor: Robert Kaiser, Winchester, Mass.

[73] Assignee: Entropic Systems, Inc., Winchester, Mass.

[21] Appl. No.: 317,382

[22] Filed: Oct. 4, 1994

[51] Int. Cl.[6] ..... B08B 13/00

[52] U.S. Cl. ..... 134/113; 134/202; 134/111

[58] Field of Search ..... 134/99.1, 184, 134/103.1, 902, 95.3, 113, 111, 56 R, 57 R, 58 R

[56] References Cited

U.S. PATENT DOCUMENTS

| | | | |
|---|---|---|---|
| 3,276,458 | 10/1966 | Iversen et al. | 134/902 |
| 3,605,775 | 9/1971 | Zaander et al. | 210/745 |
| 3,614,231 | 10/1971 | Shaw . | |
| 4,409,999 | 10/1983 | Pedziwiatr | 134/184 |
| 4,582,077 | 4/1986 | Gabriel et al. | 134/184 |
| 4,893,320 | 1/1990 | Yanagi et al. | 134/184 |
| 5,201,958 | 4/1993 | Breunsbach | 134/99.1 |
| 5,339,844 | 8/1994 | Stanford, Jr. et al. | 134/113 |
| 5,396,178 | 3/1995 | Rybarski | 134/113 |

FOREIGN PATENT DOCUMENTS

| | | | |
|---|---|---|---|
| 55-103608 | 8/1980 | Japan | 210/745 |
| 56-97512 | 8/1981 | Japan | 210/745 |
| 60-21798 | 2/1985 | Japan | 68/12.02 |
| 60-16275 | 4/1985 | Japan | 68/12.02 |
| 60-163689 | 8/1985 | Japan | 68/12.02 |
| 61-25599 | 2/1986 | Japan | 68/12.02 |
| 62-259442 | 11/1987 | Japan | 134/902 |
| 2-107296 | 4/1990 | Japan | 68/12.02 |

*Primary Examiner*—Frankie L. Stinson

*Attorney, Agent, or Firm*—Cesari and McKenna

[57] ABSTRACT

A cleaning system and method adapted for removal of small particles from solid substrates is disclosed. In one implementation, the system employs two on-line particle counters to measure particle concentrations in an incoming stream of filtered cleaning liquid, providing a baseline measurement, and in the outgoing or recirculation stream that has already made contact with the article to be cleaned. Comparison of the two measurements over time provides an accurate indication of the degree of particle removal, which is reported to the user and/or employed to control the cleaning cycle. In another implementation, the system employs a single detector that measures the magnitude of a signal (e.g., radioactivity) emitted by the particles; this signal continuously indicates the number of particles remaining on the substrate.

17 Claims, 2 Drawing Sheets

AUTOMATIC PRECISION CLEANING APPARATUS WITH CONTINUOUS ON-LINE MONITORING AND FEEDBACK

This invention was made with Government support under Air Force contract F04704-92-C-0017 and Nuclear Regulatory Commission contract 04-93-106. The Government has certain rights in this invention.

BACKGROUND OF THE INVENTION

1. Field of the Invention

The present invention relates to immersion cleaning, and in particular to a method and apparatus for removing small particles from solid substrates.

2. Description of the Related Art

Unless extraordinary precautions are taken, virtually all workpieces and manufactured items acquire or retain particulate contaminants on their surfaces during manufacture. The presence of such fine particles can deleteriously affect product quality in a wide variety of applications (for example, fabrication of semiconductors and precision instruments such as inertial guidance instruments). Particles of micrometer size or smaller are generally observed to adhere tenaciously and non-specifically to other solid surfaces, and cannot be removed by simple mechanical means or with cleaning techniques developed primarily for degreasing purposes.

Traditional techniques of removing unwanted particles include the use of chlorinated cleaning agents such as chlorofluorocarbons and methylchloroform; these, however, have been found to constitute major sources of atmospheric chlorine, which is responsible for devastation of the ozone layer. Alternative approaches have stressed the use of non-chlorinated cleaning agents. See, e.g., U.S. Pat. No. 4,711,256 (to Kaiser, entitled METHOD AND APPARATUS FOR REMOVAL 0F SMALL PARTICLES FROM A SURFACE).

Thus far, however, particle-removal materials and techniques have been used in conjunction with non-specialized equipment such as vapor degreasers. These devices, while serviceable, do not control the cleaning process in a manner directly responsive to removal of particles. For example, a user may clean an article, remove it from the cleaning solution, microscopically examine it for the continued presence of contaminating particles, and repeat the process until the particle count reaches a small enough level. Not only is this iterative procedure time-consuming and inefficient, but can also result in evaporative loss of cleaning solvent during the unproductive examination steps. Alternatively, articles can be subjected to cleaning for such an extended period as to virtually ensure the absence of particles. Once again, this approach results in unnecessary cleaning effort.

DESCRIPTION OF THE INVENTION

Objects of the Invention

Accordingly, it is an object of the invention to provide for removal of particles from an article without inefficient use of cleaning materials or energy.

It is another object of the invention to facilitate cleaning in a manner that monitors particle removal and keeps the user informed of progress.

It is yet another object of the invention to provide a cleaning method and apparatus whose operation is controlled by progress in removing particles.

Other objects will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts that are adapted to effect such steps, all as exemplified in the following summary and detailed description, and the scope of the invention will be indicated in the claims.

Brief Summary of the Invention

The foregoing objects are accomplished with a recirculating cleaning system having two on-line particle counters. A first counter measures the particle concentrations in an incoming stream of filtered cleaning liquid, providing a baseline measurement; and a second counter measures the concentrations in the recirculation stream drawn from the cleaning vessel. Comparison of the two measurements over time provides an accurate indication of the degree of particle removal, which is reported to the user and/or employed to control the cleaning cycle.

The type of cleaning liquid and the mode of cleaning can take numerous forms consistent with the invention. For example, the liquid can be a perfluorocarbon surfactant solution in which the article to be cleaned is immersed. To enhance the cleaning process, agitation (e.g., sonication with ultrasound, mechanical shear, spraying, etc.) can be introduced into immersion bath. Alternatively, different cleaning solvents and cleaning techniques (e.g., non-recirculating immersion, non-immersion spraying or vapor degreasing) can be adapted for use with the invention through appropriate modification of the cleaning equipment. So long as incoming particle counts can be compared with outgoing counts, the approach of the present invention can be straightforwardly implemented.

In the simplest embodiments, the degree of particle removal can be used to terminate the cleaning process once a sufficient decrease in removed particles is detected. In more sophisticated embodiments, cleaning with a solvent is followed by a rinse cycle, and a target degree of particle removal may be utilized as a signal to switch cycles.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
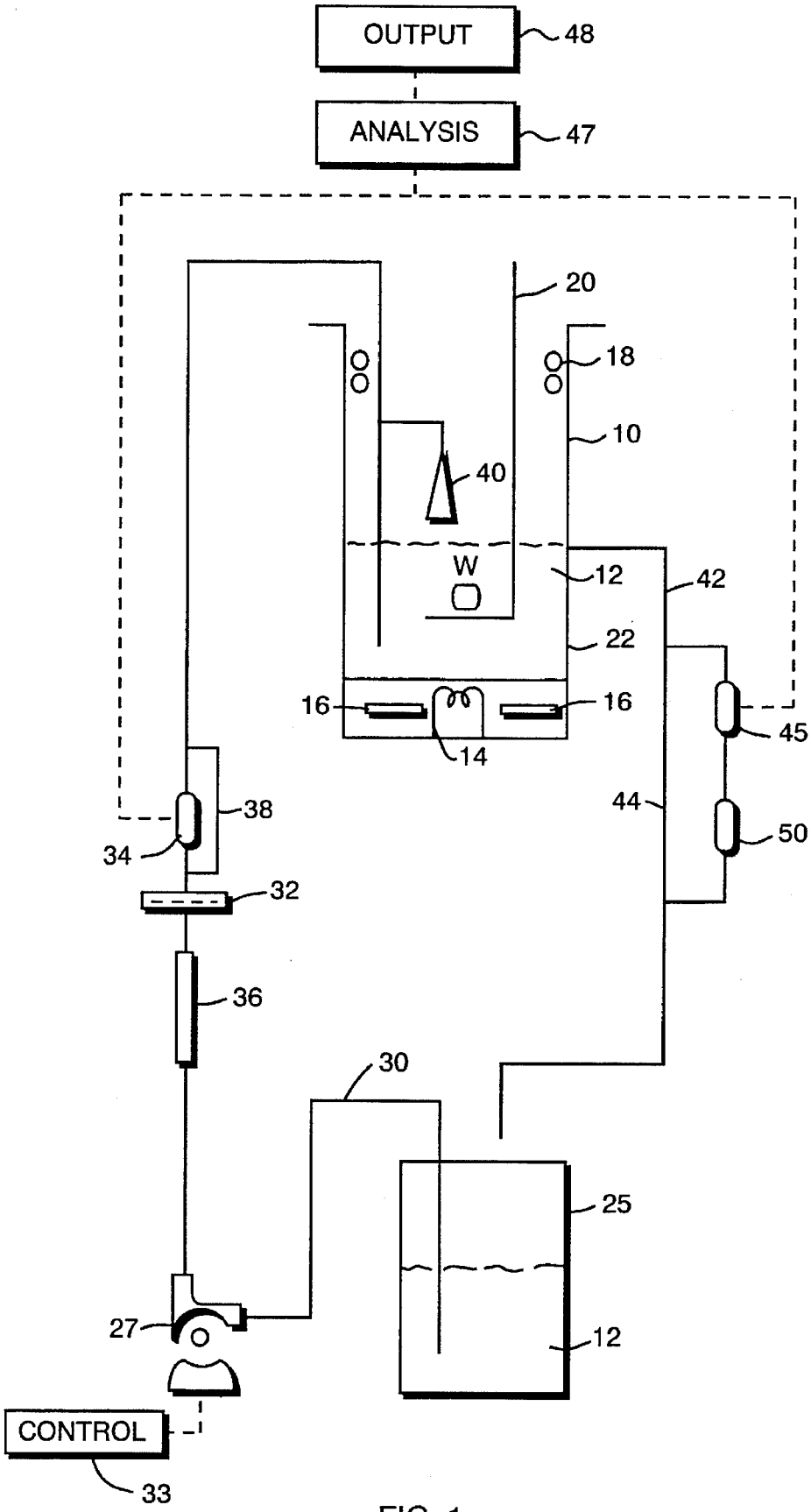
FIG. 1 is a schematic representation of a basic cleaning apparatus in accordance with the present invention.

Refer first to FIG. 1, which illustrates a basic cleaning system embodying the present invention. The system includes a vessel 10 into which a cleaning or rinsing liquid 12 may be introduced. A heater 14 selectably warms the liquid residing in vessel 10, while an ultrasonic transducer 16 acoustically agitates the liquid to assist in the cleaning process. (As noted earlier, other well-known sources of cleaning agitation can be substituted for transducer 16 if desired.) A set of cooling coils 18 condense solvent vapors as they rise, thereby confining them within the vessel 10.

The workpiece or workpieces W are desirably suspended in an immersion sump of vessel 10 by suitable means, such as a basket 20, a shelf or a containment cell coupled to a lift for transfering workpieces W in and out of vessel 10, although, in simplified embodiments, the workpieces may simply rest on the floor 22 of the immersion sump.

A supply of liquid 12 resides in a storage vessel 25. The liquid is conveyed by means of a pump 27 to vessel 10 via one or more conduits defining a flow path 30, which includes a membrane filter assembly 32 and an on-line particle counter 34. Filter 32 is used to minimize the concentration of background particles; useful for this purpose is the MILLIPAK 200 0.22 μm filter cartridge supplied by Millipore Corp., Ashby Road, Bedford, Mass. Optionally, controlled variation of the flow rate can be facilitated by introduction of a flow meter 36 into flow path 30 and a controller 33 that governs the action of pump 27. A typical flow rate is 20 to 30 ml/min through sensor 34; however, a bypass loop 38 can be employed to accommodate higher flow rates by diverting excess flow around sensor 34. Flow path 30 can reach vessel 10 through a suitable inlet or by means of a spray nozzle 40 directed into vessel 10 (and desirably against workpiece W). In the latter case, spray nozzle 40 may provide sufficient agitation to fully substitute for ultrasonic transducer 16.

Liquid 12 is returned to vessel 25 over a second flow path 42, which includes a second particle counter 45 (and, if high flow rates are desired, a second bypass loop 44). Preferably, vessel 25 is located beneath vessel 10 such that liquid 12 can simply drain into the vessel. Particle counters 34, 45 are preferably cells that incorporate a laser and a measurement photodiode. In operation, laser radiation is directed across the liquid flowing through the cell and onto the photodiode, the output of which is measured by a pulse-height analyzer 47 and interpreted as a particle concentration by a display output unit 48, which reports this concentration. One suitable type of particle counter employs an ultraviolet (UV) laser and photodiode sensor; advantageous results have been obtained using the MET-One Model LB-1010 or LB-1020 light-blocking sensors, supplied by MET-One, Inc. 481 California Avenue, Grants Pass, Orea., which can detect particles as small as 1 μm. Alternatives include sensors that operate through light scattering (instead of light blockage), which can detect particles down to 0.1 μm; and radiation detectors, as described in greater detail below. In any of these implementation, the functions of units 47 and 48 are carried out on a 486SX microcomputer that collects, analyzes and stores the particle-count data using MET-One Logware 3 software.

If desired, a spectrophotometer 50 can be introduced into flow path 42 to monitor any changes in the chemical composition of liquid 12. The apparatus can also include a ball float or similar device to warn the user of an inadequate supply of liquid in vessel 10.

In operation, a cleaning liquid is first circulated through vessel 10 until the output of counter 45 approaches, within tolerable limits, the output of counter 34. At this point the workpiece can be removed, suspended in a vapor zone above the surface of liquid 12 as in a traditional vapor degreaser, or rinsed. In the latter case, vessel 25 is filled with a rinse liquid that is once again circulated through flow paths 30, 42. A preferred embodiment of the invention utilizes the cleaning method disclosed in U.S. Pat. No. 4,711,256 (to Kaiser, entitled METHOD AND APPARATUS FOR REMOVAL OF SMALL PARTICLES FROM A SURFACE), hereby incorporated by reference in its entirety. In particular, the cleaning liquid is a high-molecular-weight, highly fluorinated organic surfactant in a non-ionic highly fluorinated organic carrier, and the rinse liquid is a highly fluorinated organic liquid, all as defined in the '256 patent.

Figure 2:
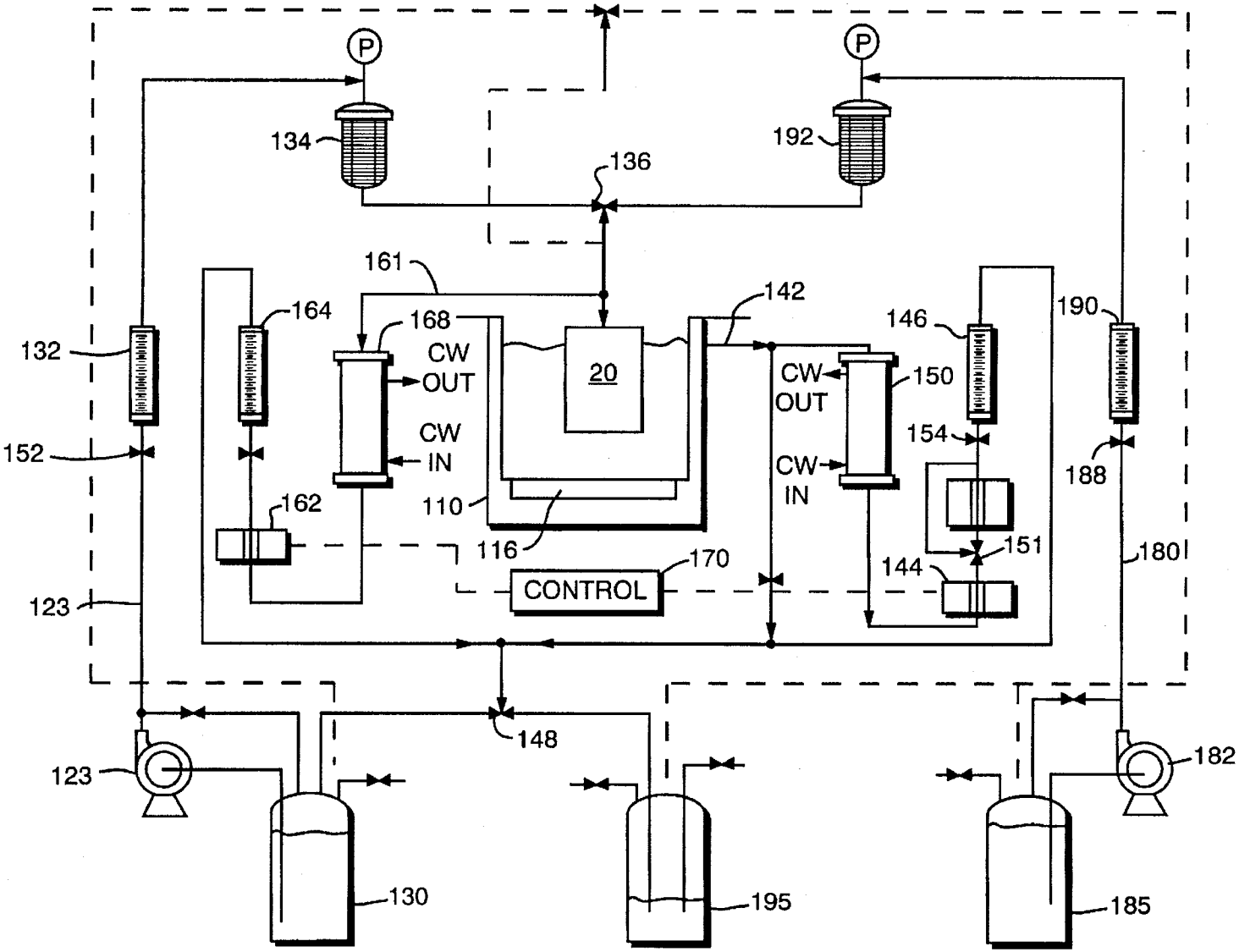
FIG. 2 is a schematic representation of a more sophisticated cleaning apparatus in accordance with the present invention.

Refer now to FIG. 2, which illustrates a more elaborate version of the inventive cleaning apparatus. The illustrated system includes two principal flow circuits: a closed-loop cleaning circuit and an open-loop rinse circuit, both directed through a single containment vessel 110. Once again, vessel 110 preferably includes an ultrasonic transducer array 116.

The cleaning circuit comprises a flow path 123, driven by a pump 125, that leads from a cleaning-liquid storage vessel 130 through a flow meter 132, a membrane filter assembly 134, and a three-way inlet valve 136 to vessel 110; and a return path 140 leading from vessel 110 (by means of an outlet conduit 142) through a first particle counter 144 and a second flow meter 146 back to vessel 130 through a three-way valve 148 set at a recirculation position. Path 140 can also include a heat exchanger 150 equipped with suitable cooling water entrance and exit ports as indicated, and a spectrophotometer 151. A pair of valves 152, 154 control the overall circulation rate.

An analytical test stream is drawn from path 123 before liquid enters vessel 110. This stream follows a flow path 161, passing through a second particle detector 162 and a third flow meter 164 before reaching valve 148, which directs the liquid into vessel 130. Flow path 161 can also include a heat exchanger 168. A control unit 170 constantly monitors the difference in particle concentrations detected by the first and second particle counters 144, 162.

The rinse circuit comprises a flow path 180, driven by a pump 182, that leads from a rinse-liquid storage vessel 185 through a control valve 188, a flow meter 190, a membrane filter assembly 192, and inlet valve 136. Spent rinse liquid is conveyed to a waste container 195 over flow path 140, with valve 148 set at an outflow position. Vessels 130 and 195 are preferably connected by a pressure-equalization line. Liquid accumulating in vessel 175 is discarded or recycled off-line.

In addition to obtaining particle-concentration data from the particle counters, control unit 170 displays this data to the user, and preferably utilizes it to directly supervise operation of the apparatus. In furtherance thereof, control unit 170 operates (by means of suitable electronic actuators) valves 136, 148, 152, 154 and 188, as well as pumps 125 and 185. When activated by the user, control unit 170 initiates cleaning by opening valves 152; setting valve 136 to direct liquid from flow path 123 into vessel 110; setting valve 148 to return liquid to vessel 130; and turning on pump 125. Control unit 170 keeps valve 154 closed until the liquid in vessel 110 reaches an adequate height (as detected, for example, by a suitable ball float). If suspension device 20 includes a lifting mechanism, control unit 170 also operates this to lower the articles to be cleaned into vessel 110.

When the particle concentrations measured by counter 144 begin to approach those reported by counter 162, control unit 170 terminates the cleaning cycle and initiates the rinse cycle by closing valve 152; allowing the cleaning liquid in vessel 110 to drain into vessel 130; closing valve 154; reversing the positions of valves 136 and 148; opening valve 188; and turning on pump 182. Control unit keeps valve 154 closed until a sufficient amount of rinse liquid has accumulated in vessel 110. Control unit 170 can maintain the rinse flow over paths 140 and 180 for a predetermined time, or use the output of spectrophotometer 151 to monitor the composition of the rinse liquid and terminate the cycle when the effluent contains no more soil or only insignificant traces of cleaning liquid.

The foregoing designs can be modified to efficiently measure and react to cleaning of articles contaminated with radioactive particles. In this environment, the particles themselves carry detectable signatures, and it is therefore unnecessary to measure relative numbers of particles released into the cleaning stream using a two-counter system; instead the aggregate radioactivity remaining in the vessel 10 or 110 (or on the workpiece W) can be used directly to assess the efficacy of cleaning. For example, the embodiment illustrated in FIG. 1 can be modified to implement this approach by eliminating counter 34 and locating counter 45 in vessel 10 (or associating it more intimately with workpiece W). In this case, counter 45 may be, for example, a 3×3 NaI scintillation gamma detector. Analysis module 47 is equipped with suitable amplification circuitry to detect and measure the signal from detector 45. The magnitude of this signal indicates the degree to which a non-radioactive workpiece W is purged of contaminating radioactive particles, which are trapped in filter 32 as cleaning liquid 12 circulates. Cleaning is terminated and workpiece W withdrawn when the signal reaches a sufficiently small value. The embodiment illustrated in FIG. 2 can be analogously modified to accommodate this single-detector approach.

It will therefore be seen that I have developed a versatile cleaning system that facilitates efficient and reliable removal of small particles. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. An immersion cleaning apparatus suitable for removing small particles from an article, the apparatus comprising:

a. a housing comprising an immersion sump for receiving an article to be cleaned;

b. inflow means for conducting fluid into the housing;

c. outflow means for conducting fluid from the immersion sump out of the housing;

d. first particle-detection means, coupled to the inflow means, for detecting, in a fluid flowing through the inflow means, a concentration of particles larger than a predetermined minimum size;

e. second particle-detection means, coupled to the outflow means, for detecting, in a fluid flowing through the outflow means, a concentration of particles larger than the predetermined size; and f. reporting means for displaying the particle concentrations detected by the first and second particle-detection means.

2. The cleaning apparatus of claim 1 further comprising:

a. a vessel for containing a cleaning fluid;

b. a first inflow conduit coupling the vessel to the inflow means;

c. a first outflow conduit coupling the vessel to the outflow means and arranged to conduct fluid from the immersion sump to the vessel; and d. means for pumping fluid from the vessel through the first inflow conduit and into the inflow means.

3. The cleaning apparatus of claim 2 wherein the vessel is positioned below the immersion sump and fluid drains by gravity through the first outflow conduit into the vessel.

4. The cleaning apparatus of claim 1 further comprising means for agitating a liquid in the immersion sump.

5. The cleaning apparatus of claim 4 wherein the agitation means is an ultrasonic transducer.

6. The cleaning apparatus of claim 4 wherein the agitation means is a spray nozzle.

7. The cleaning apparatus of claim 1 wherein the particle-detection means include UV spectrophotometers.

8. The cleaning apparatus of claim 7 further comprising a cleaning fluid that is substantially transparent to UV radiation.

9. The cleaning apparatus of claim 8 wherein the cleaning fluid is a fluorinated liquid.

10. The apparatus of claim 1 further comprising means for filtering fluid before the fluid reaches the housing.

11. An immersion cleaning apparatus suitable for removing small particles from an article the apparatus comprising:

a. a housing comprising an immersion sump for receiving an article to be cleaned;

b. inflow means for conducting fluid into the housing;

c. outflow means for conducting fluid from the immersion sump out of the housing;

d. first particle-detection means, coupled to the inflow means, for detecting a particle concentration in a fluid flowing through the inflow means;

e. second particle-detection means, coupled to the outflow means, for detecting a particle concentration in a fluid flowing through the outflow means; and f. a vessel for containing a cleaning fluid;

g. a first inflow conduit coupling the vessel to the inflow means;

h. a first outflow conduit coupling the vessel to the outflow means and arranged to conduct fluid from the immersion sump to the vessel;

i. means for pumping fluid from the vessel through the first inflow conduit and into the immersion sump;

j. a second vessel for containing a rinse fluid;

k. a second inflow conduit coupling the second vessel to the inflow means;

l. a second outflow conduit;

m. means for pumping fluid from the second vessel through the second inflow conduit and into the immersion sump; and n. cycle control means for operating the pumping means to circulate, in a first cycle, the cleaning fluid from the first vessel to the immersion sump and back to the first vessel, and thereafter, in a second cycle, to circulate the rinse fluid from the second vessel into and out of the immersion sump.

12. The cleaning apparatus of claim 11 wherein:

a. the control means is coupled to the particle-detection means; and b. the control means terminates the first cycle and initiates the second cycle based on the particle concentrations detected by the first and second particle-detection means.

13. The cleaning apparatus of claim 11 further comprising reporting means for displaying the particle concentrations detected by the first and second particle-detection means.

14. The apparatus of claim 11 further comprising means for filtering fluid before the fluid reaches the housing.

15. An immersion cleaning apparatus suitable for removing from an article small particles that emit a detectable signal, the apparatus comprising:

a. a housing comprising an immersion sump for receiving an article to be cleaned;

b. inflow means for conducting fluid into the housing;

c. outflow means for conducting fluid from the immersion sump out of the housing;

d. means for detecting the signal emitted by the particles on the article; and e. reporting means for displaying the magnitude of the detected signal, said magnitude being indicative of particle concentration on the article.

16. The apparatus of claim 15 wherein the particles are radioactive and the detection means is a scintillation detector.

17. The cleaning apparatus of claim 15 wherein the cleaning fluid is a fluorinated liquid.

* * * * *